US012768350B2

(12) United States Patent
Pierce et al.

(10) Patent No.: US 12,768,350 B2
(45) Date of Patent: Oct. 20, 2026

(54) UNIVERSAL PUMP BRACKET

(71) Applicant: Viking Pump, Inc., Cedar Falls, IA (US)

(72) Inventors: Justin Pierce, Waterloo, IA (US); Andrew Anderson, Cedar Falls, IA (US); Alfonso Johnson, Cedar Falls, IA (US); Dylan Lende, Waterloo, IA (US); Scott Meyer, Brandon, IA (US)

(73) Assignee: Viking Pump, Inc., Cedar Falls, IA (US)

( * ) Notice: Subject to any disclaimer, the term of this patent is extended or adjusted under 35 U.S.C. 154(b) by 0 days.

(21) Appl. No.: 18/472,711

(22) Filed: Sep. 22, 2023

(65) Prior Publication Data

US 2024/0102471 A1 Mar. 28, 2024

Related U.S. Application Data

(60) Provisional application No. 63/409,463, filed on Sep. 23, 2022.

(51) Int. Cl.
*F04C 2/08* (2006.01)
*F04C 15/00* (2006.01)

(52) U.S. Cl.
CPC ..... *F04C 2/086* (2013.01); *F04C 15/0003* (2013.01); *F04C 15/0034* (2013.01); (Continued)

(58) Field of Classification Search
CPC .. F04C 2/086; F04C 15/0003; F04C 15/0034; F04C 15/0038; F04C 2240/30; F04C 2240/50; F04C 2240/52
See application file for complete search history.

(56) References Cited

U.S. PATENT DOCUMENTS 2,057,205 A 10/1936 Petersen
2,131,968 A 10/1938 Peterson
(Continued)

FOREIGN PATENT DOCUMENTS

EP 3078857 A1 10/2016
FR 1308375 A 12/1961

OTHER PUBLICATIONS

What is Design for Manufacturing or DFM?, by East West Manufacturing, 14 Pages, Published Mar. 24, 2020. (Year: 2020).*
(Continued)

*Primary Examiner* — Mary A Davis
(74) *Attorney, Agent, or Firm* — Tucker Ellis LLP

(57) ABSTRACT

One or more techniques and/or systems are disclosed for a universal-type bracket that incorporates a substantially uniform diameter through-bore. This allows the bracket to accept current sealing arrangements used in these types of pumps, while providing the same or better sealing options as current individual designs. The single through-bore can have multiple undercut features for holding a pump shaft bushing, with an increased wall thickness to allow for an appropriate interference fit with the walls of the through-bore, for example, similar to previous designs. Retaining ring grooves can be added to the through-bore, and retaining rings may be used to provide a positive shoulder for the seal or packing rings to seat against inside the bore. This may allow for various sealing options, such as stuffing seals, one-piece barrier seals, cartridge seals, BTR seals, component seals, and more.

15 Claims, 9 Drawing Sheets

(52) U.S. Cl.
CPC ..... *F04C 15/0038* (2013.01); *F04C 2240/30* (2013.01); *F04C 2240/50* (2013.01); *F04C 2240/52* (2013.01)

(56) References Cited

U.S. PATENT DOCUMENTS

| | | | | | |
|---|---|---|---|---|---|
| 3,360,932 | A | * | 1/1968 | Lech | B62D 5/097 180/441 |
| 3,712,765 | A | | 1/1973 | Smith | |
| 4,743,184 | A | * | 5/1988 | Sumikawa | F04C 18/3446 418/104 |
| 5,662,462 | A | * | 9/1997 | Paley | F04C 15/0038 277/423 |
| 6,158,994 | A | | 12/2000 | Mulcahy | |
| 6,368,086 | B1 | | 4/2002 | McInerney | |
| 9,394,903 | B2 | * | 7/2016 | Jablonski | F04C 2/165 |
| 10,138,889 | B2 | * | 11/2018 | Yano | F04C 27/009 |
| 10,760,685 | B2 | * | 9/2020 | Iehl | F04C 15/0038 |
| 11,168,794 | B2 | * | 11/2021 | Mihm | F04C 15/0038 |
| 2004/0134277 | A1 | | 7/2004 | Daigre | |

OTHER PUBLICATIONS

The International Search Report and The Written Opinion of the International Searching Authority, or the Declaration for corresponding PCT Application No. PCT/US2023/074860, dated Jan. 10, 2024, 12 pages.

* cited by examiner

UNIVERSAL PUMP BRACKET

CROSS-REFERENCE TO RELATED APPLICATIONS

This application claims priority to U.S. Provisional Patent Application Ser. No. 63/409,463, entitled UNIVERAL PUMP BRACKET, filed Sep. 23, 2022, which is incorporated herein by reference.

BACKGROUND

Rotating shaft pumps can be used to pump fluid, in myriad applications. A rotating shaft pump typically has a stuffing box where packing material, glands and followers are used to mitigate leakage of pump fluid from the pumping chamber along the shaft. Currently, rotating pumps use one bracket design when the sealing features is disposed in the bracket stuffing box, and use a different bracket design when the seal is disposed directly behind the rotor of the pump, and not in a stuffing box.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

One or more techniques and systems are described herein for a redesigned, universal-type bracket that incorporates a single, relatively uniform diameter, through-bore. This can allow the bracket to accept the majority of current sealing arrangement used in these types of pumps, while providing the same or better sealing options as current individual designs. This universal-type bracket design can effectively allow a distributor or end user to stock a common bracket, and configure it as needed, which can lead to lower cost, less inventory, and shortened lead times.

In one implementation of a universal-type pump bracket, the bracket has a single through-bore with multiple undercut features, instead of a typical stepped-bore, for holding a pump shaft bushing. In this implementation, the shaft bushing wall thickness can be increased to match the larger diameter of the bracket bore, which can allow for an appropriate interference fit with the walls of the through-bore, for example, similar to previous designs. For example, because a shoulder created by a stepped-bore is no longer present, retaining ring grooves can be added to the through-bore, and retaining rings may be used to provide a positive shoulder for the seal or packing rings to seat against inside the bore.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

DETAILED DESCRIPTION

Figure 1A:
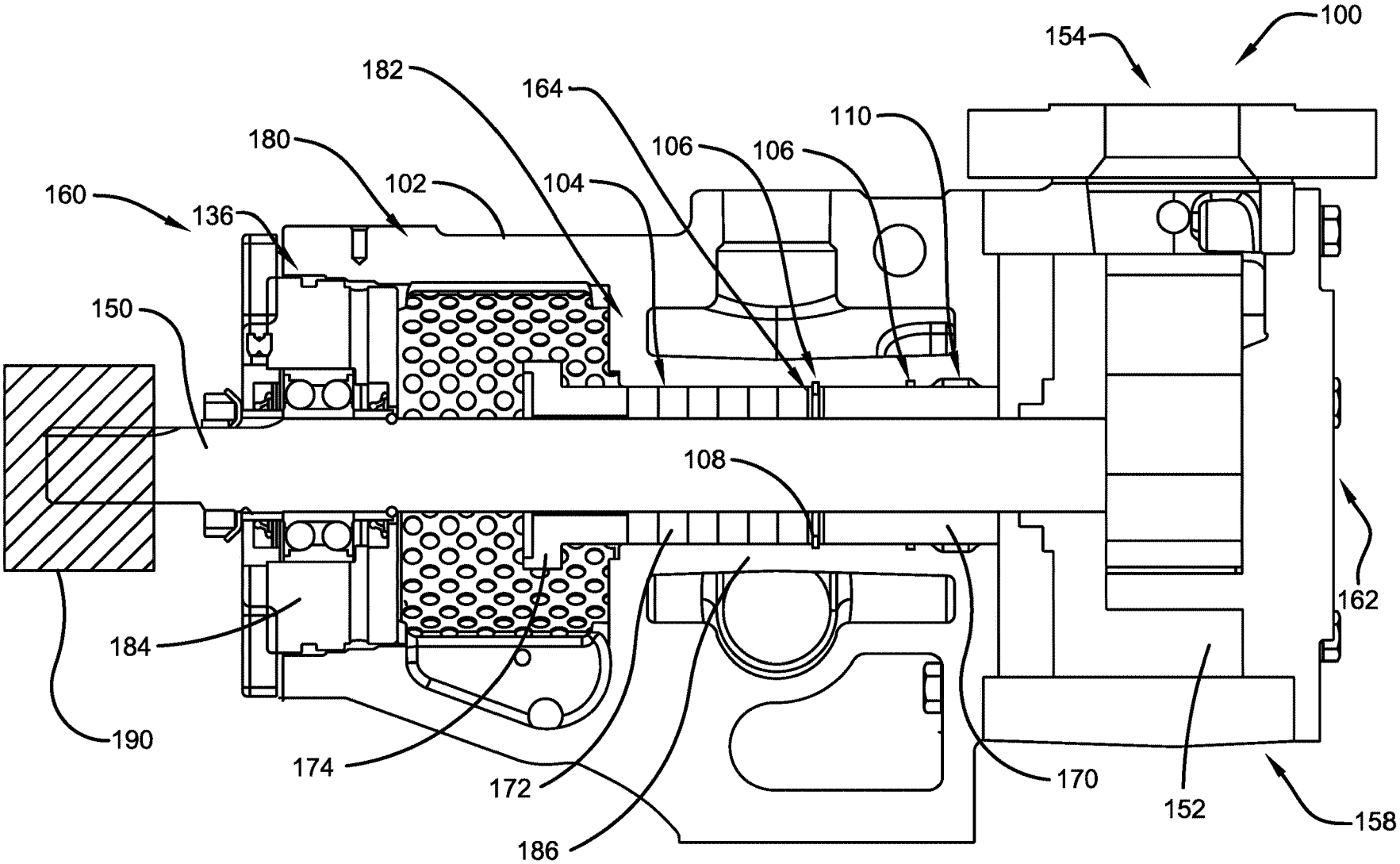
FIG. 1A is a component diagram illustrating a cut-away view of portions of an example pump, where the universal-type bracket design, described herein, may be implemented.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

In one aspect, a universal-type bracket can be devised for a rotating shaft pump. Prior brackets utilized a series of stepped shoulders in the internal bore to provide stops for the shaft packing or seal, to position it in place. The universal-type bracket described herein utilizes a through-bore instead of the stepped shoulder design. The through-bore is appropriately sized to hold a target bushing in place with an interference fit. Further, a series of grooves can be disposed in the wall(s) of the through-bore, into which a retaining ring may be disposed. The grooves that receive the retaining ring can be disposed at appropriate locations for receiving various shaft packing or seals in place, thereby retaining the seal in the desired location along the pump shaft. In this aspect, in some implementations, because the bore is a single diameter along its length, the bushing can be pressed or shrink fit into multiple locations or depths from the bracket face to allow a sealing mechanism to be located in various desired arrangements. For example, when placing a seal behind the rotor, a relief undercut or kerf can be added to the bracket bore to mitigate cutting or damaging the mechanical seal seat gasket (e.g., O-ring) during installation. In this way, the bracket described herein can allow a single bracket to be used for most of the sealing arrangements provided for this type of pump.

Figure 1B:
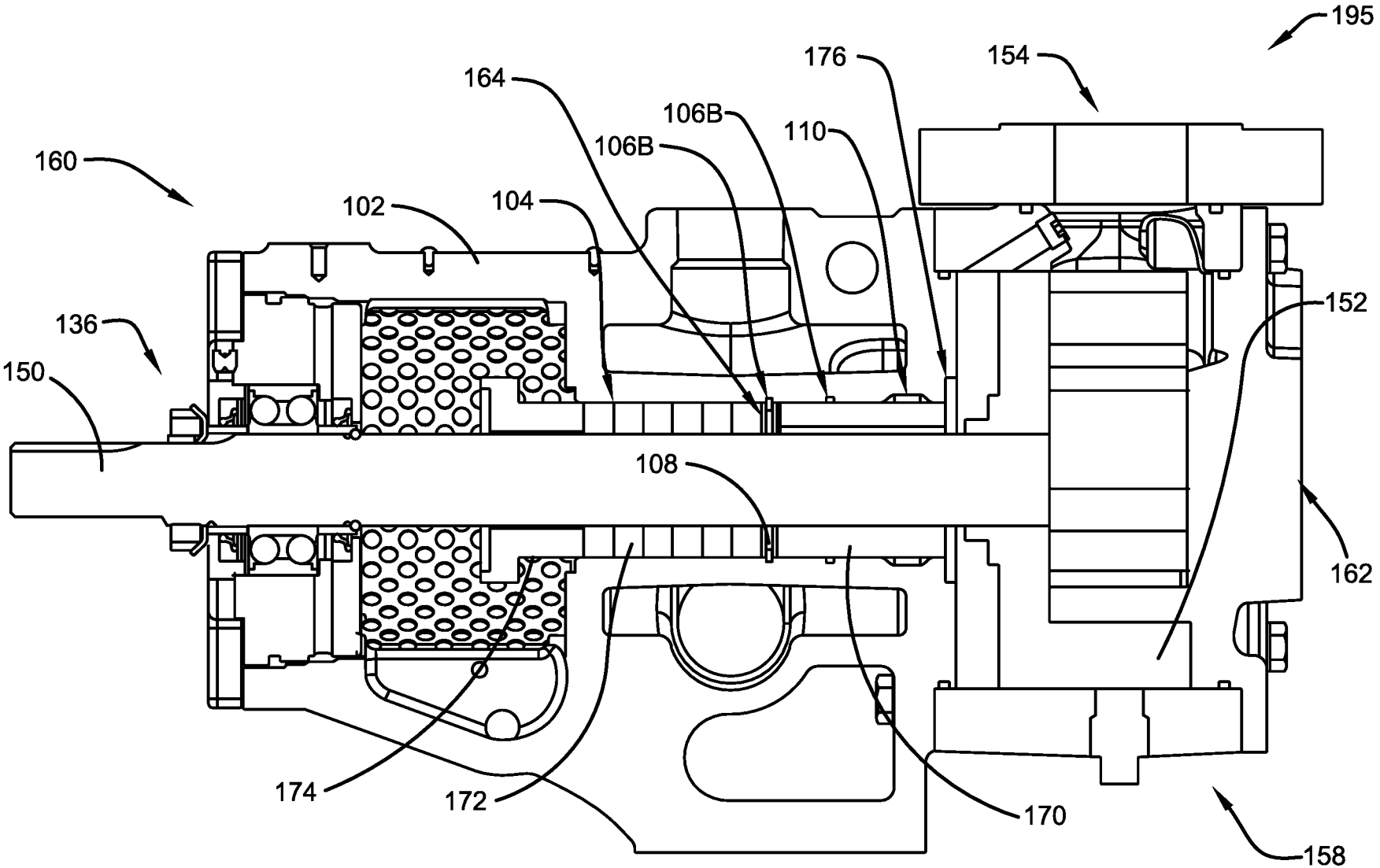
FIG. 1B is a component diagram illustrating a cut-away view of portions of an alternate implementation of example pump, where the universal-type bracket design, described herein, may be implemented.

FIGS. 1A and 1B are component diagrams illustrating a cut-away view of alternate versions of an example rotary shaft pump 100, 195. The pump 100 comprises a pump shaft 150 that operably couples to a prime mover 190, such as a motor or the like, to provide rotation power to the shaft. The prime mover 190 (e.g., housing of the motor) can be operably, fixedly engaged with a bracket 102, which can be operably fixedly engaged with a rotor housing 158. The shaft 150 is coupled to a rotor 152 that rotates to pump fluid into and out of ports 154. A threaded bearing housing 136 is disposed at the proximal end 160 of the bracket 102, in a first portion 180 of the bracket 102. A bearing assembly 184 is disposed in the bearing housing 136 to support the shaft 150 during operation. The opening of the threaded bearing housing 136 may enable easy end clearance adjustment for various applications, such as for installing various types of sealing mechanisms in the bracket 102. In this example, a pump bracket 102 (e.g., a universal-type bracket) houses the various parts of the pump 100, and couples with the rotor housing 158 (or pump chamber housing that houses the rotor 152 coupled to the shaft 150). Further, the pump bracket 102 can comprise feet to stabilize the pump 100 on a surface, and/or provide for fastening to a surface for operation.

As illustrated, in this implementation, the pump bracket 102 comprises a stuffing box 104 disposed in a second portion 182 of the bracket 102. The stuffing box 104 comprises a wall 186 with a through-bore between the proximate side 160 (e.g., a first end that is proximate the prime mover or motor in operation) and the distal side 162 (e.g., a second end that is distal from the prime mover) of the bracket 102. That is, the stuffing box 104 provides a housing for sealing material around the shaft 150, to mitigate leakage of pumped fluid along the shaft, from the rotor 152. In this implementation, the through-bore of the bracket stuffing box 104 comprises a uniform diameter (e.g., without stepped shoulders as in prior designs) along its length. For example, this diameter can be sized larger than the diameter of the shaft 150 such that a bearing, or other types of sealing devices, can be disposed between the wall 186 and the shaft 150.

Further, as illustrated, the bracket stuffing box 104 can comprise one or more grooves or channels 106 disposed in the wall 186, which are respectively configured (e.g., shaped and sized) to receive a retaining ring 108. In some implementations, one or more of the channels or grooves 106 can receive a gasket, such as an O-ring, such as for a one-piece barrier seal. Additionally, the bracket stuffing box 104 can comprise one or more cutouts 110, 176 that are configured to facilitate holding a mechanical seal in place, and to hold a mechanical seal seat gasket (e.g., O-ring) in place, and to mitigate cutting or damaging of the gasket the during installation. Additionally, the one or more channels or grooves 106, 106B may be configured to receive a retaining ring to retain one or more of the components in place in the bracket.

In this example of FIGS. 1A and 1B, the bracket stuffing box 104 is fitted with the bracket bushing 170, which can be interference fit into the through-bore of the bracket stuffing box 104. The channel or groove 106, 106B is disposed in a location that allows the retaining ring 108 to retain the packing 172 and packing washer 164 in the desired position in the bracket stuffing box 104. Packing material 172 (e.g., or seal stuffing, sealing material, etc.) is disposed proximally from a bushing 170 that can be disposed in the stuffing box 104 using an interference fit. A packing gland 174 (e.g., or gland follower) is disposed behind the packing material 172. In this example, the packing gland 174 can be fastened to the bracket 102 at a flange portion, which provides a compressive force to the packing material 172. In this way, the packing material 172 is compressed and spreads out radially to provide a seal between the walls of the bracket stuffing box 104 and the shaft 150. In FIG. 1B, a distal channel cut-out 176 is disposed at the distal end of the stuffing box 104, proximate the rotor 152.

Figure 2A:
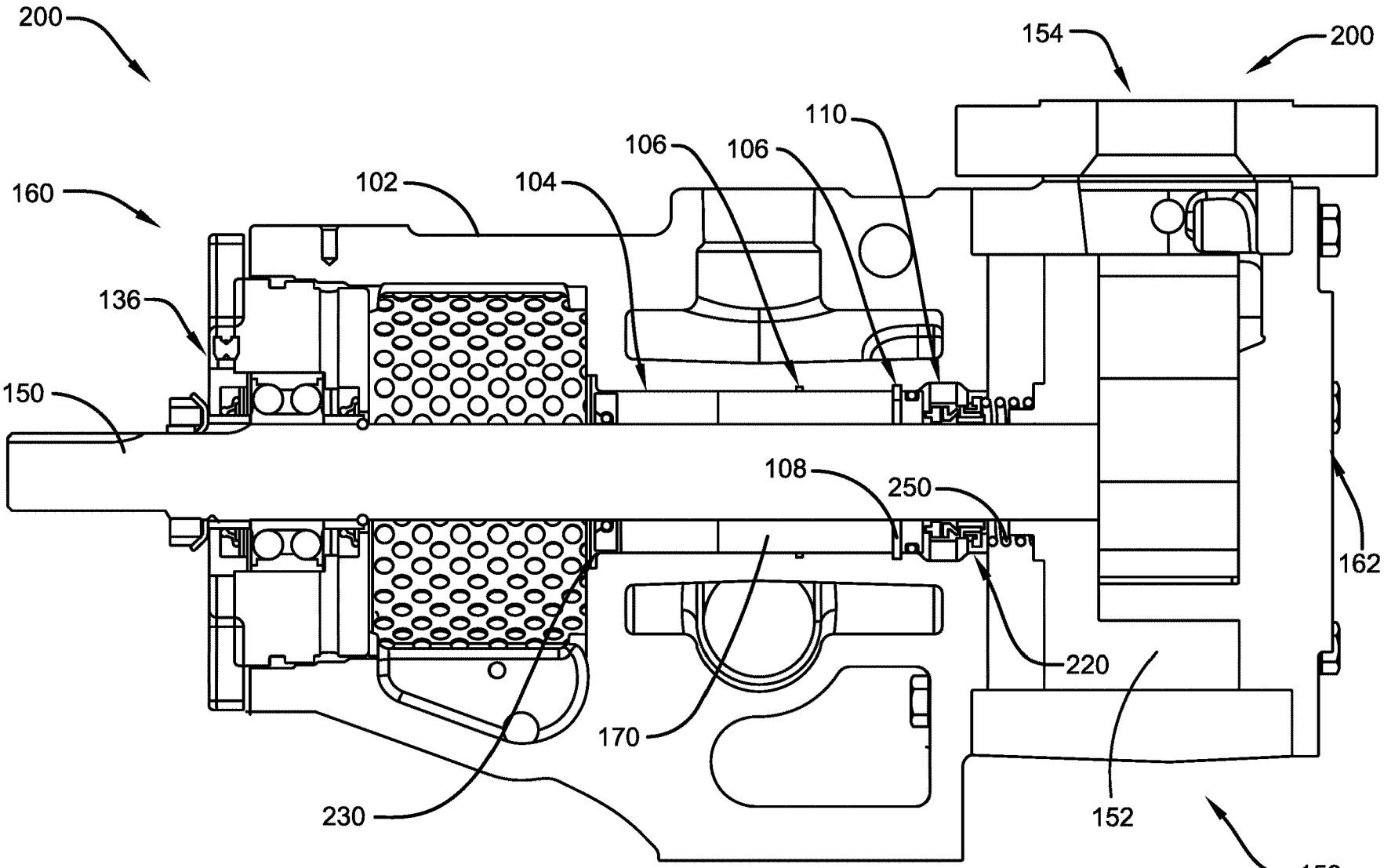
FIG. 2A is a component diagram illustrating a cut-away view of portions of an example pump, where the universal-type bracket design, described herein, may be implemented.
Figure 2B:
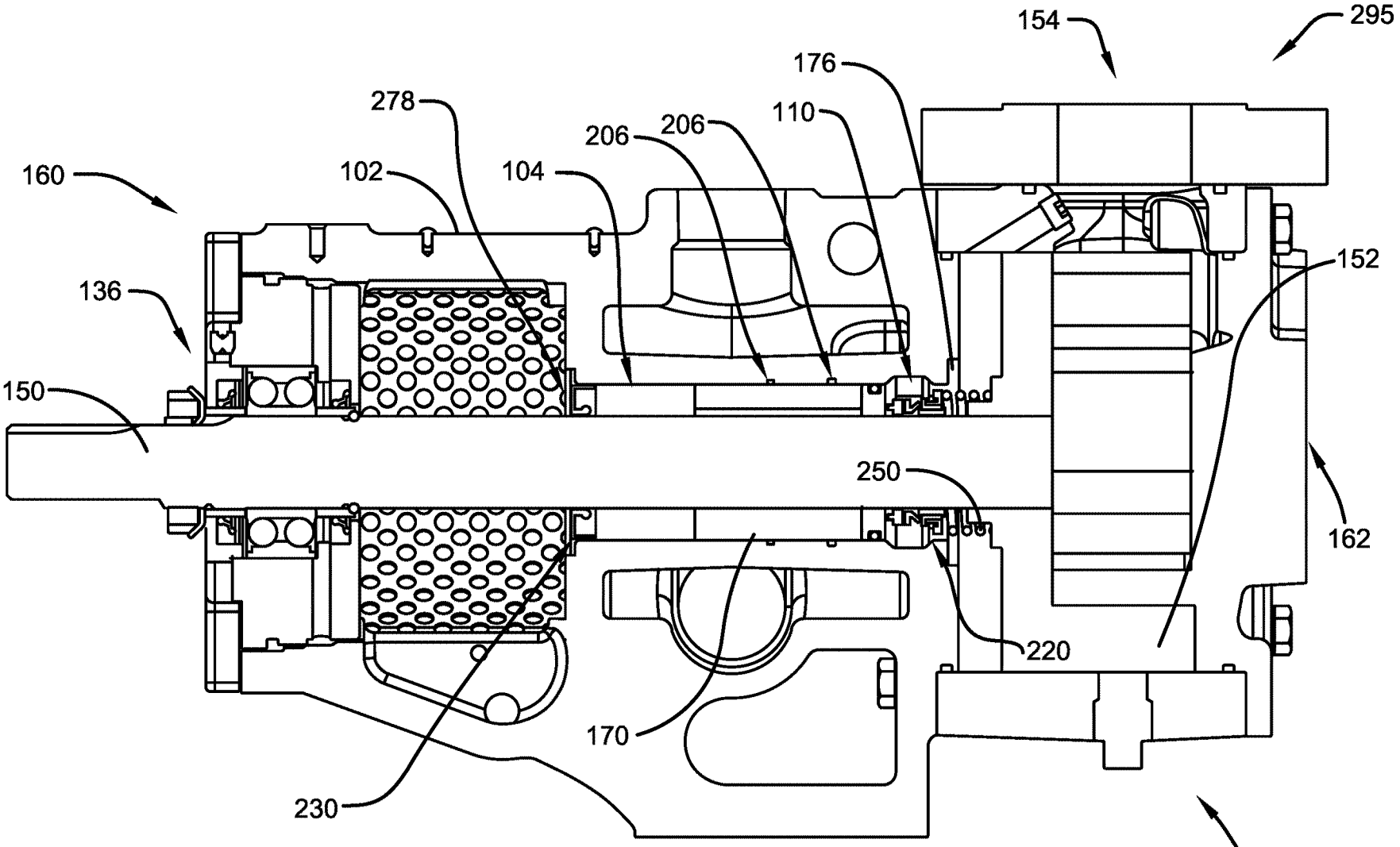
FIG. 2B is a component diagram illustrating a cut-away view of portions of an alternate implementation of example pump, where the universal-type bracket design, described herein, may be implemented.

FIGS. 2A and 2B are alternate example implementations 200, 295 of the pump 100, 195, respectively, where a different type of seal may be utilized in the universal-type bracket 102. In this example implementation 200, 295, the bracket stuffing box 104 comprises the same through-bore, with respective grooves or channels 106 configured to receive the retaining ring 108, along with the cutout 110. However, in this implementation, a behind-the-rotor (BTR) seal 220 is provided as a seal and used to mitigate leakage along the shaft 150. The BTR seal 220 is a mechanical seal configured to fit just past cutout 110 of the bracket stuffing box 104, and, in FIG. 2A, is held in place at the proximal side by the retaining ring 108, which is disposed in a channel/groove 106 placed in an appropriate position for retaining the component seal 220. In FIG. 2B, the BTR seal 220 is configured to fit just past the cutout 110 of the bracket stuffing box 104, and is pressed against the bracket bushing 170 (e.g., or against the retaining ring 108) at its proximal end.

At the distal end, the BTR seal 220 is held in place by a biasing spring 250 disposed against the rotor 152. Further, the bracket bushing 170 is fitted (e.g., by interference fit) into the bracket stuffing box 104 proximally from the BTR seal 220. As illustrated, the same bracket 102 can be used for two different types of seals (FIGS. 1 and 2). In some implementations, the BTR seal 220 is disposed against the bushing 170 for position, and the retaining ring 108 (e.g., and the channel of groove 106) may not be present. Additionally, a lip seal 230 is disposed at the proximate end of the stuffing box 104, for holding grease lubrication for the shaft 150 and bushing 170.

Figure 3A:
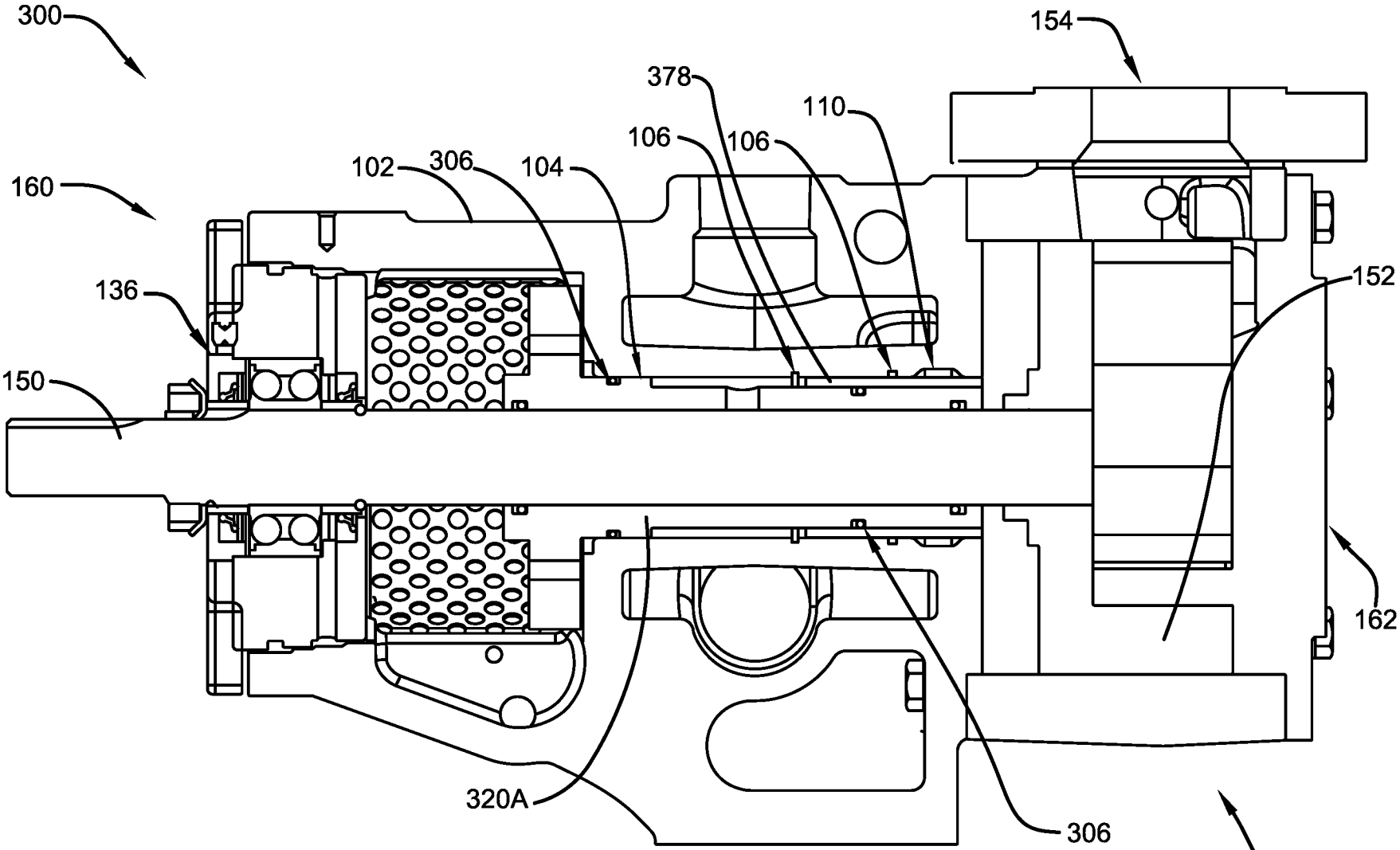
FIG. 3A is a component diagram illustrating a cut-away view of portions of an example pump, where the universal-type bracket design, described herein, may be implemented.
Figure 3B:
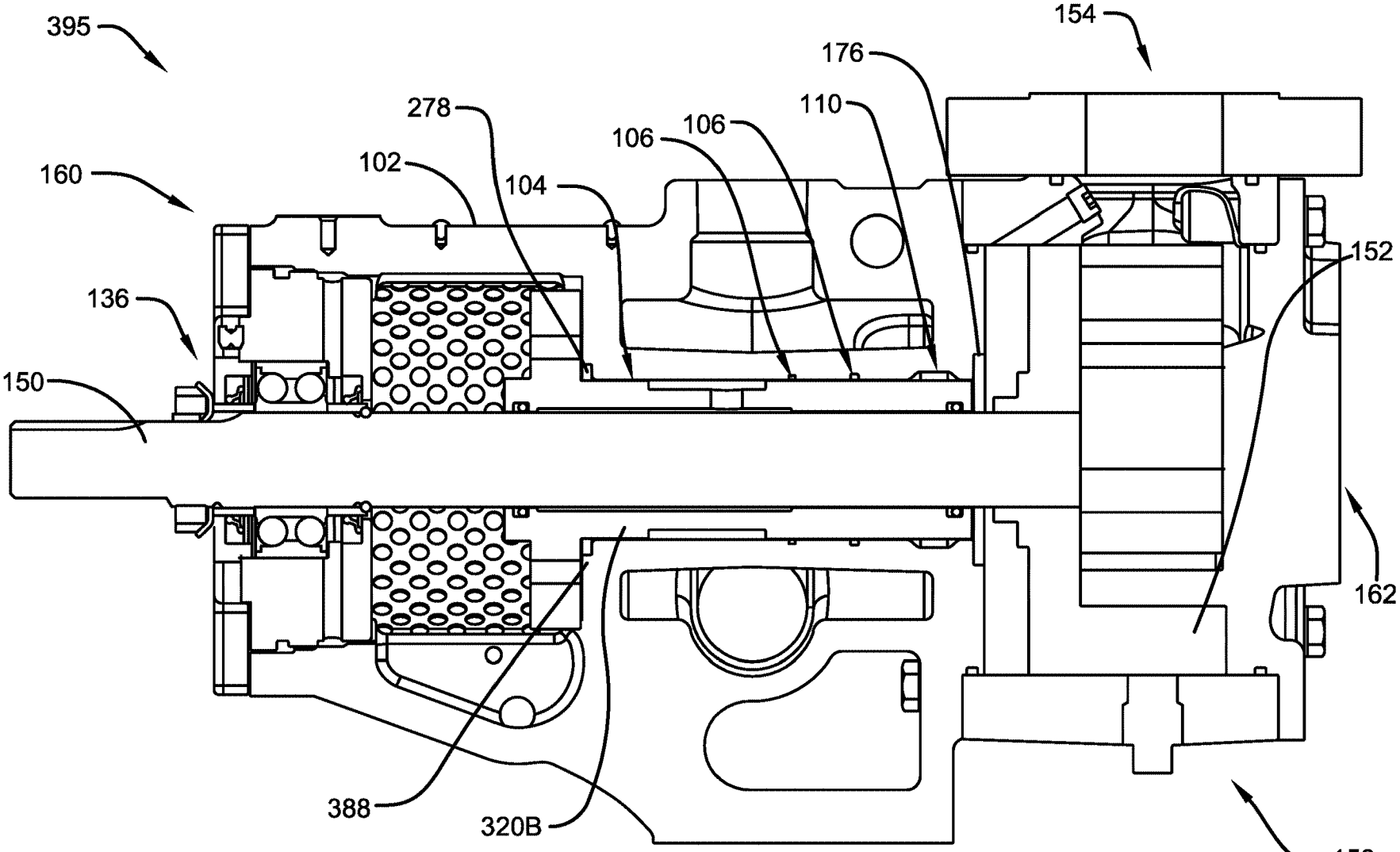
FIG. 3B is a component diagram illustrating a cut-away view of portions of an alternate implementation of example pump, where the universal-type bracket design, described herein, may be implemented.

FIGS. 3A and 3B are other alternate example implementations 300, 395 of the pump 100, 195, respectively, where a different type of seal may be utilized in the universal-type bracket 102. In this example implementation 300, 395 the bracket stuffing box 104 comprises the same through-bore, with respective grooves or channels 106 configured to receive a gasket, along with the cutout 110. However, in this implementation, a one-piece barrier seal 320A, B is disposed in the bracket stuffing box 104, and used to mitigate leakage along the shaft 150. The barrier seal 320A, B is configured to fit the through-bore of the bracket stuffing box 104, and is held in place at the proximal side by fastening the flange portion of the barrier seal 320 to the body 388 of the bracket 102. In this implementation, the one-piece barrier seal 320A, B provides a bearing surface for the shaft 150, and provides gaskets along its body for the purpose of sealing between the shaft 150 and the walls of the bracket stuffing box 104. That is, for example, the barrier seal 320A, B is a one-piece barrier seal comprising a monolithic gland-packing-bushing configuration.

As illustrated, the same bracket 102 can be used for three different types of seals (FIGS. 1A-3B). In FIG. 3A, a bracket sleeve 378 is disposed around the barrier seal 320A at the distal end of the stuffing box 104, to provide support for the shaft 150 during operation. In FIG. 3B, the diameter of the barrier seal 320B is wider, which eliminates the need for the bracket sleeve 378. Additionally, in FIG. 3A, seal gasket channels 306 are disposed in the outside wall of the barrier seal 320A of pump 300, and configured to receive gaskets.

Figure 4:
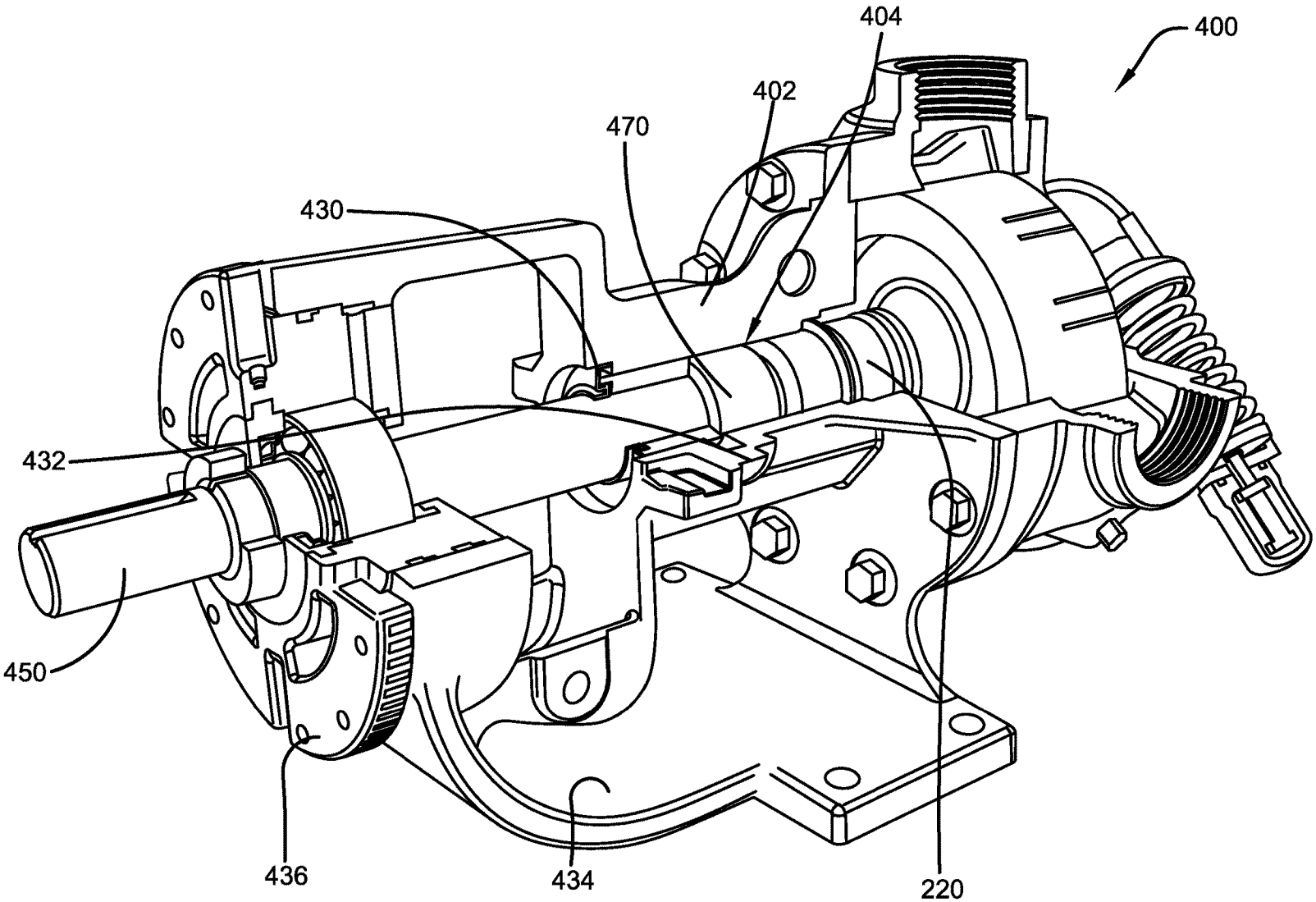
FIG. 4 is a component diagram illustrating a cut-away view of portions of an example pump, where a stepped-bore bracket design, described herein, may be implemented.

FIG. 4 is another example implementation, in quarter cut-away view, of a pump 400 with a stepped-bore bracket 402 design. In this example implementation, the BTR seal 220 is used as the sealing mechanism, with the shaft bushing 470 disposed proximally from the BTR seal 220 in the bracket stuffing box 404. Further, in this implementation, a lip seal 430 is disposed at the proximal end of the bracket stuffing box 404, and a grease/lubricant port 432 is fluidly coupled with the bracket stuffing box 404 to allow lubricant to be operably injected into a space formed between the shaft 450 and the interior walls of the bracket stuffing box 404. As an example, the lubricant can be introduced through the lubricant port 432, and retained by the lip seal 430, to provide lubrication to the rotating shaft 450 and bracket bushing 470 during operation. In some implementations, an exit lubrication port (not shown) can be fluidly coupled with the lubricant port 432 to provide for fluid to exit, such as under pressure. Additionally, a rigid mounting bracket 434 can be formed as part of (e.g., or fastened to) this bracket 402, and may also be formed with the universal-type bracket 102; and a threaded bearing housing 436 supports the shaft 450 and may enable easy end clearance adjustment for various applications. As an example, the universal bracket design 102 may be used to replace this stepped-bore design bracket 402.

FIGS. 5A-5E illustrate several example implementations of a pump 500 and various sealing mechanisms used with the stepped-bore design type bracket 502, which can be replaced with the universal bracket design 102, described herein. That is, in this implementation, the second portion 582 of the bracket 502, at the second end 562 (e.g., distal end), comprises a stuffing box 504 that has an internal wall 586 with just a first diameter bore 576 at the proximal end, and a second diameter bore 574 at the distal end. In this example, the first diameter 576 is larger than the second diameter 574. In this example implementation, the pump comprises the bracket stuffing box 504 with the uniform diameter through-bore, stepped down at the distal end, which can house the shaft bushing 570, along with various sealing mechanisms, shown in FIGS. 5B-5E. As illustrated, the pump 500 comprises the bracket 502, which can comprise a mounting bracket 534, along with an attached threaded bearing housing 536, which holds the bearing assembly 584, to support the shaft 550. The pumping chamber 558 is fluidly coupled with the port 554 (inlet and outlet) to pump fluid to coupled piping (not shown), using the rotor 552.

Figure 5A:
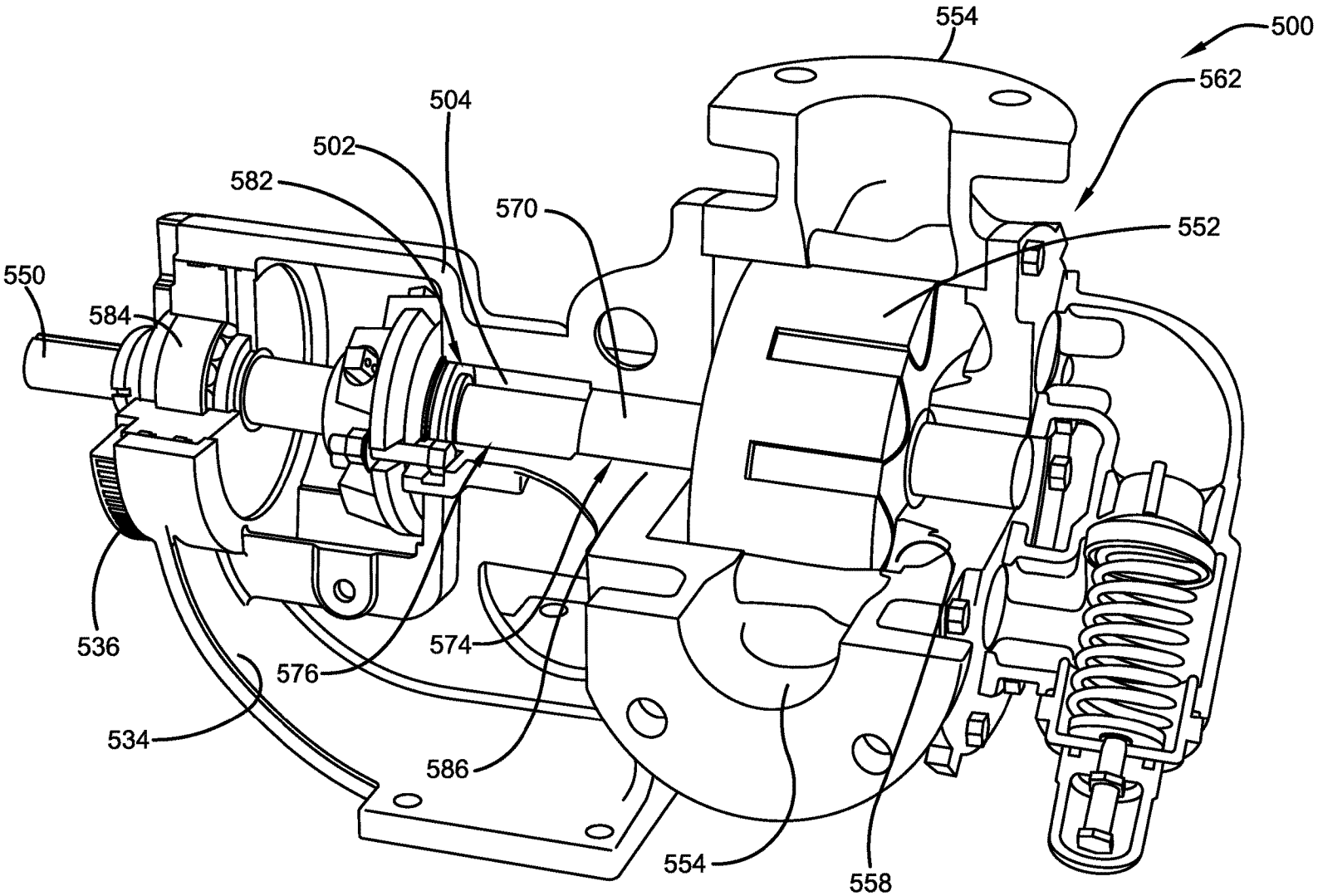
FIGS. 5A, 5B, 5C, 5D, and 5E are component diagrams illustrating cut-away views of portions of an example pump, where another stepped-bore bracket design, described herein, may be implemented.
Figures 5B, 5C, 5D, 5E:
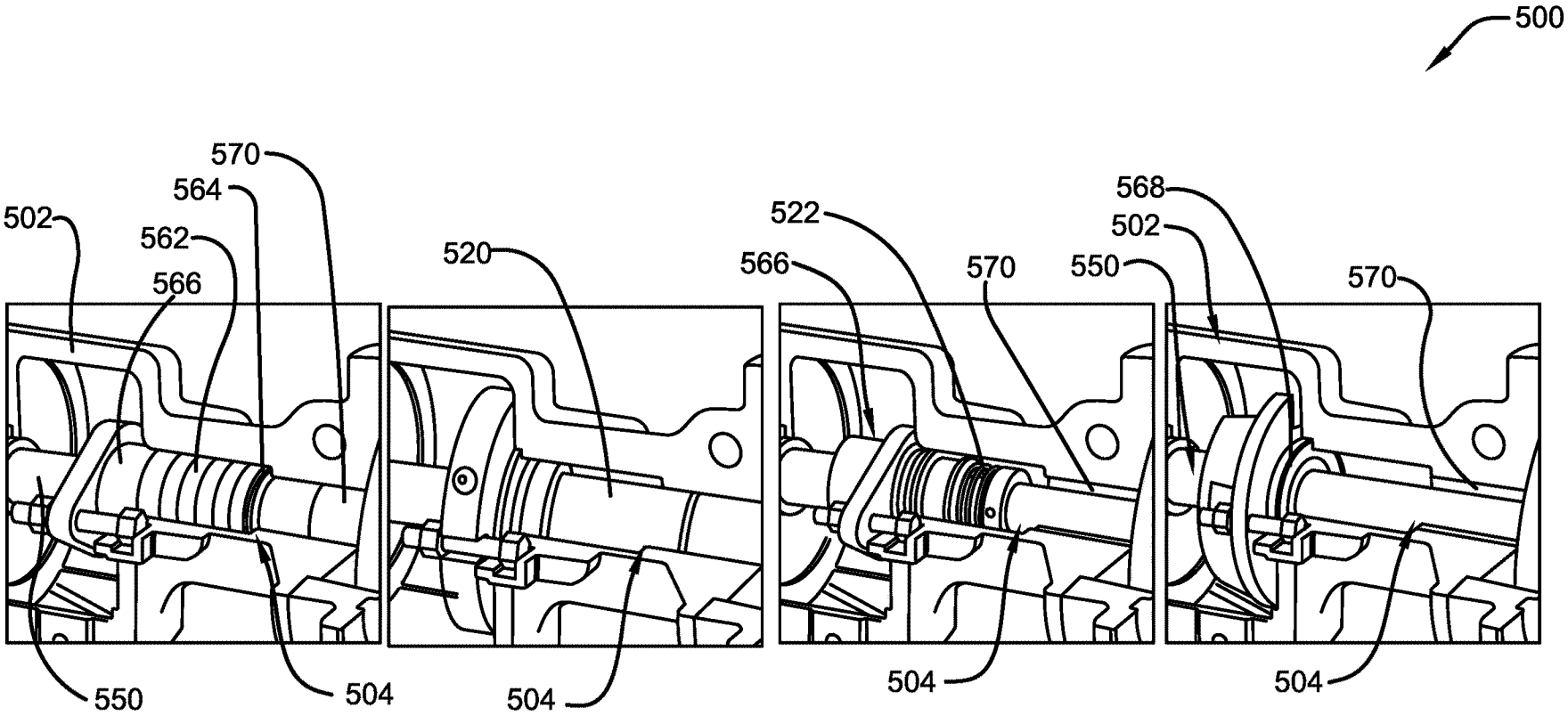

As illustrated in FIG. 5B, packing material 562 can be held in place with a packing gland 566, against a packing washer 564 against a shoulder formed between the first diameter 576 and the second diameter 574, in the bracket stuffing box 504. As illustrated in FIG. 5C, a one-piece barrier seal 520 is disposed in the bracket stuffing box 504, and used to mitigate leakage along the shaft 550. As described above, the one-piece barrier seal 520 comprises sealing elements (e.g., gaskets, O-rings) disposed along its length, and also comprises a bushing and flange portion to fasten to the bracket 502. As illustrated in FIG. 5D, a component mechanical seal 522 is disposed in the bracket stuffing box 504, and used to mitigate leakage along the shaft 550. The component seal 522 comprises various sealing elements to mitigate fluid leakage, and a packing gland 566 can fasten to the bracket 502 to hold the component seal 522 in place. Further, the bracket bushing 570 can be disposed in the bracket stuffing box 504 distally from the component seal 522. As illustrated in FIG. 5E, a cartridge mechanical seal 568 is disposed in the bracket stuffing box 504, and used to mitigate leakage along the shaft 550. The cartridge seal 568 comprises various sealing elements to mitigate fluid leakage, and a flange to fasten to the bracket 502. Further, the bracket bushing 570 can be disposed in the bracket stuffing box distally from the cartridge seal 568. As noted, these various seal options, BTR seal 220, packing type seal 562, one-piece barrier seal 520, component mechanical seal 522, and cartridge seal 576, may all be used in the universal-type bore bracket design 102, described herein, for example, instead of needing separate brackets for each different seal.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, At least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure. In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. A universal bracket for use with a variety of sealing configurations for a rotating shaft fluid pump, comprising:

a body, the body being a singular component, the body comprising:

a first end that is configured to be operably disposed proximal to a coupled prime mover providing power;

a second end that is configured to be operably disposed distal from the coupled prime mover;

a first bore at the first end, the first bore configured to fixedly hold a bearing assembly in place during operation at the proximal end; and a second bore at the second end, the second bore being coaxial with the first bore, the second bore having a proximal end and a distal end, the second bore comprising a stuffing box that has an internal wall with a substantially uniform diameter, the wall of the stuffing box being configured to engage and hold a seal, the wall of the stuffing box comprising a first annular channel around the perimeter, a second annular channel around the perimeter, and an annular cutout at the distal end, the body having a mounting face at the proximal end of the second bore, the mounting face having a mounting pattern configured to receive at least one fastener to secure a seal, wherein the stuffing box is configured to selectively and operably hold the following sealing configurations:

a packing gland-packing material-bushing held configuration configured to be held in place by at least the first annular channel;

a component mechanical seal configuration configured to be held in place by at least the mounting face and mounting pattern;

a cartridge mechanical seal configuration configured to be held in place by at least the mounting face and mounting pattern;

a behind the rotor (BTR) mechanical seal configuration configured to be held in place by the second annular channel and/or the annular cutout; and a one-piece barrier seal comprising a monolithic gland-packing-bushing configuration configured to be held in place by at least the mounting face and mounting pattern.

2. The universal bracket of claim 1, wherein the bracket is configured to operably, fixedly engage with a pumping chamber at the distal end.

3. A pump subassembly, comprising: the universal bracket of claim 1, and the behind the rotor (BTR) mechanical seal operably held in the stuffing box at the distal end by the annular cutout.

4. A pump subassembly, comprising: the universal bracket of claim 1 and a retaining ring disposed in one of the first annular channel or the second annular channel, the retaining ring operably retaining a packing washer and packing material at a proximal end of the stuffing box.

5. A pump subassembly, comprising: the universal bracket of claim 1 and a retaining ring disposed in the second annular channel, the retaining ring operably retaining the behind the rotor (BTR) mechanical seal at a distal end of the stuffing box.

6. A pump subassembly, comprising: the universal bracket of claim 1 and a gasket disposed in one of the first annular channel or the second annular channel, the gasket operably directly engaged with the one-piece barrier seal to mitigate fluid migration.

7. A pump subassembly, comprising: the universal bracket of claim 1 and a lip seal at the proximal end of the stuffing box.

8. A pump subassembly, comprising: the universal bracket of claim 1 and the bearing assembly disposed at the proximal end of the first bore, the bearing assembly configured to operably support the rotating shaft of the fluid pump.

9. The universal bracket of claim 1, the body further comprising an opening that transversely extends through the body and is located between the first end and the second end, wherein the opening separates the first bore and the second bore.

10. An assembly comprising a pump chamber at a distal end with a pump rotor engaged with a rotating shaft, a prime mover applying rotational power to the shaft at a proximal end, the assembly comprising:

a universal bracket selectably engaged between the prime mover and the pump chamber having the rotating shaft disposed through the universal bracket, the universal bracket being a singular component, the universal bracket comprising:

a first end engaged with the prime mover;

a second end engaged with the pump chamber;

a first bore at the first end, the first bore configured to operably hold a bearing assembly in place during operation at the proximal end; and a second bore at the second end, the second bore being coaxial with the first bore, the second bore having a proximal end and a distal end, the second bore comprising a stuffing box that has an internal wall with a substantially uniform diameter, wherein the diameter is larger than the rotating shaft, the internal wall being configured to engage and hold a seal, the wall of the stuffing box comprising a first annular channel around the perimeter, a second annular channel around the perimeter, and an annular cutout at the distal end, the body having a mounting face at the proximal end of the second bore, the mounting face having a mounting pattern configured to receive at least one fastener to secure a seal;

a bearing assembly disposed at the proximal end of the first bore, the bearing assembly operably holding the rotating shaft; and a shaft seal disposed in the stuffing box between the rotating shaft and the internal wall to mitigate fluid migration along the shaft, wherein the stuffing box is configured to selectively and operably hold the following sealing configurations:

a packing gland-packing material-bushing held configuration configured to be held in place by at least the first annular channel;

a component mechanical seal configuration configured to be held in place by at least the mounting face and mounting pattern;

a cartridge mechanical seal configuration configured to be held in place by at least the mounting face and mounting pattern;

a behind the rotor (BTR) mechanical seal configuration configured to be held in place by the second annular channel and/or the annular cutout; and a one-piece barrier seal comprising a monolithic gland-packing-bushing configuration configured to be held in place by at least the mounting face and mounting pattern.

11. The assembly of claim 10 comprising a retaining ring disposed in the first annular channel or second annular channel, the retaining ring operably retaining a packing washer and packing material at a proximal end of the stuffing box.

12. The assembly of claim 10, comprising a retaining ring disposed in the second annular channel, the retaining ring operably retaining the behind the rotor (BTR) mechanical seal at a distal end of the stuffing box.

13. The assembly of claim 10, comprising a gasket disposed in the first annular channel or second annular channel, the gasket operably directly engaged with the one-piece barrier seal to mitigate fluid migration.

14. The assembly of claim 10, comprising the behind the rotor (BTR) mechanical seal operably held in the stuffing box at the distal end by the annular cutout.

15. A rotating shaft pump comprising:

a pump chamber at a distal end of the pump, the pump chamber comprising a pump rotor engaged with a rotating shaft;

a prime mover engaged with the rotating shaft at a proximal end of the pump to operably apply rotational power to the pump rotor in the pump chamber;

a universal bracket selectably engaged between the prime mover and the pump chamber having the rotating shaft disposed through the universal bracket, the universal bracket being a singular component, the universal bracket comprising:

a first end engaged with the prime mover;

a second end engaged with the pump chamber;

a first bore at the first end, the first bore having a first diameter at the proximal end; and a second bore at the second end, the second bore being coaxial with the first bore, the second bore having a proximal end and a distal end, the second bore comprising a stuffing box that has an internal wall with a second diameter at the distal end, wherein the first diameter is larger than the second diameter, the wall of the stuffing box being configured to engage and hold a seal, the internal wall comprising a first annular channel around the perimeter, a second annular channel around the perimeter, and an annular cutout at the distal end, the body having a mounting face at the proximal end of the second bore, the mounting face having a mounting pattern configured to receive at least one fastener to secure a seal;

one or more gaskets and/or retaining rings disposed in the first annular channel and/or second annular channel;

a bearing assembly fixedly engaged with the first bore at the proximal end, the bearing assembly operably supporting the rotating shaft; and a shaft seal disposed in the stuffing box between the rotating shaft and the internal wall to mitigate fluid migration along the rotating shaft, wherein the shaft seal comprises a bearing disposed in the second diameter, wherein the stuffing box is configured to selectively and operably hold the following sealing configurations:

a packing gland-packing material-bushing held configuration configured to be held in place by at least the first annular channel;

a component mechanical seal configuration configured to be held in place by at least the mounting face and mounting pattern;

a cartridge mechanical seal configuration configured to be held in place by at least the mounting face and mounting pattern;

a behind the rotor (BTR) mechanical seal configuration configured to be held in place by the second annular channel and/or the annular cutout; and a one-piece barrier seal comprising a monolithic gland-packing-bushing configuration configured to be held in place by at least the mounting face and mounting pattern.

* * * * *